US006011453A

United States Patent [19]

Glinder et al.

[11] Patent Number: 6,011,453

[45] Date of Patent: Jan. 4, 2000

[54] COMPACT WAVE GUIDE ARRANGEMENT AND A METHOD FOR PRODUCING IT

[75] Inventors: Per Glinder, Göteborg; Anders Qvist, Kungsbacka; Kennet Berntsson, Nödinge, all of Sweden

[73] Assignee: Telefonaktiebolaget LM Ericsson, Stockholm, Sweden

[21] Appl. No.: 08/862,031

[22] Filed: May 22, 1997

[30] Foreign Application Priority Data

May 23, 1996 [SE] Sweden ..... 9601955

[51] Int. Cl.[7] ..... H01P 1/02; H01P 3/123

[52] U.S. Cl. ..... 333/248; 333/209; 333/249

[58] Field of Search ..... 333/239, 248, 333/249, 126, 134, 135, 208, 209; 29/600

[56] References Cited

U.S. PATENT DOCUMENTS

| | | | |
|---|---|---|---|
| 3,292,115 | 12/1966 | La Rosa | 333/208 |
| 3,686,596 | 8/1972 | Albee | 333/249 |
| 4,812,789 | 3/1989 | Lee | 333/248 X |
| 5,381,596 | 1/1995 | Ferro | 29/600 |
| 5,541,612 | 7/1996 | Josefsson | 343/771 |
| 5,574,412 | 11/1996 | Nilsson | 333/122 |
| 5,581,217 | 12/1996 | Macdonald | 333/239 X |

FOREIGN PATENT DOCUMENTS

| | | | |
|---|---|---|---|
| 319 629 | 6/1989 | European Pat. Off. . | |
| 62-141801 | 6/1987 | Japan | 333/248 |
| 4-299601 | 10/1992 | Japan | 333/208 |

OTHER PUBLICATIONS

Derwent's Abstract, No. 88–090824/13, Abstract of SU 1334–226–A (Aug. 30, 1987).

*Primary Examiner*—Seungsook Ham

*Attorney, Agent, or Firm*—Burns, Doane, Swecker & Mathis, L.L.P.

[57] ABSTRACT

A waveguide device for transmitting and processing microwave signals includes a plate structure having recesses forming waveguides for the transmitting the microwave signals between microwave components. The plate structure includes a body plate and covering plates for connection to opposite surfaces of the body plate. The body plate and the covering plates form delimiting surfaces for the waveguides, and the microwave components can be positioned in the body plate or the covering plates.

14 Claims, 5 Drawing Sheets

COMPACT WAVE GUIDE ARRANGEMENT AND A METHOD FOR PRODUCING IT

TECHNICAL FIELD

The present invention relates to a wave guide arrangement for the transmission and processing of microwave signals. The arrangement consists of a plate structure, in which recesses form wave guides for the microwave signals.

The present invention also relates to a method for producing a wave guide arrangement for the transmission and processing of microwave signals.

TECHNICAL BACKGROUND

The traditional way of producing microwave components is to produce each component, such as wave guide filters, circulators, etc., separately, and then to join them to each other, using a number of separate wave guide elements on a supporting structure or mounting plate. This technique demands a great deal of space, is expensive, and results in a large amount of connections which are imperfect, with the risk of negative influence on the function.

SUMMARY OF THE INVENTION

The object of the present invention is to obtain a wave guide means and a method of production, by means of which is achieved a compact construction technique with small tolerances and fewer steps of manual assembly.

In a wave guide arrangement according to the invention, the plate structure is formed by a body plate and at least two covering plates. These are intended to be connected against two opposite sides of the body plate, thus forming at least part of the wave guides. Further, some of the microwave components are arranged in the body plate and the covering plate, respectively.

A method according to the invention comprises the making of wave guide grooves in the side surfaces of the body plate, and openings for through connections in the two covering plates. The wave guide grooves are then closed by connecting the covering plates with the sides of the body plate.

An advantage of the invention is that the plate structure can both enclose microwave components, and can also support microwave components. In this way, compact, stable, and small units can be built in a cost efficient way.

BRIEF DESCRIPTION OF THE DRAWINGS

The invention will in the following be described in detail by means of embodiments, with reference to the appended drawings in which.

FIG. 6 is a cross section of the wave guide arrangement in the shape of a microwave component which is a circulator insert, while

PREFERRED EMBODIMENTS

Figure 1:
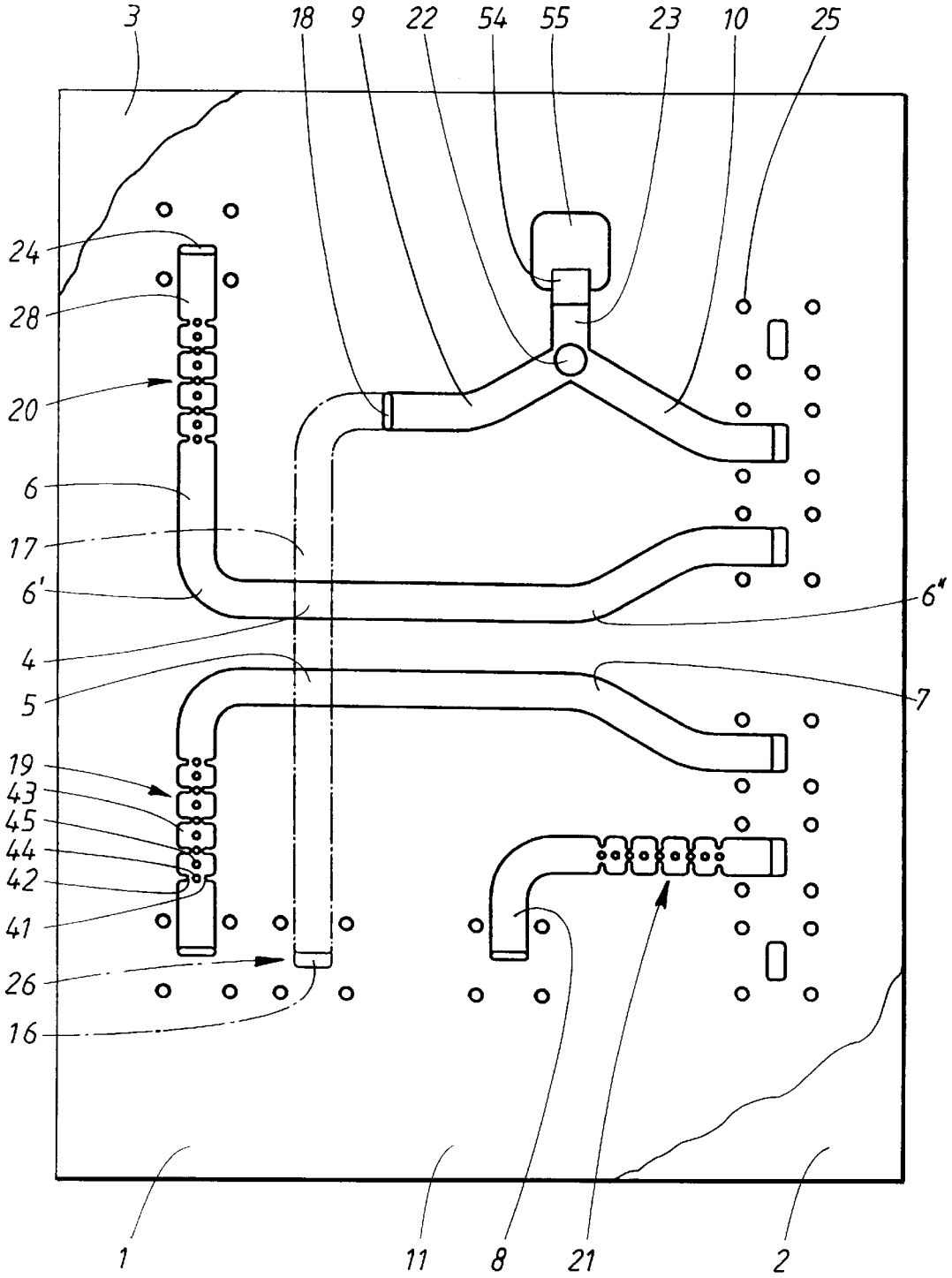
FIG. 1 shows an example of a wave guide arrangement according to the present invention, FIG. 2 in a larger scale shows a cross-section of the wave guide arrangement according to the invention in a part which has a wave guide component in the shape of a deep E-bend.
Figure 2:
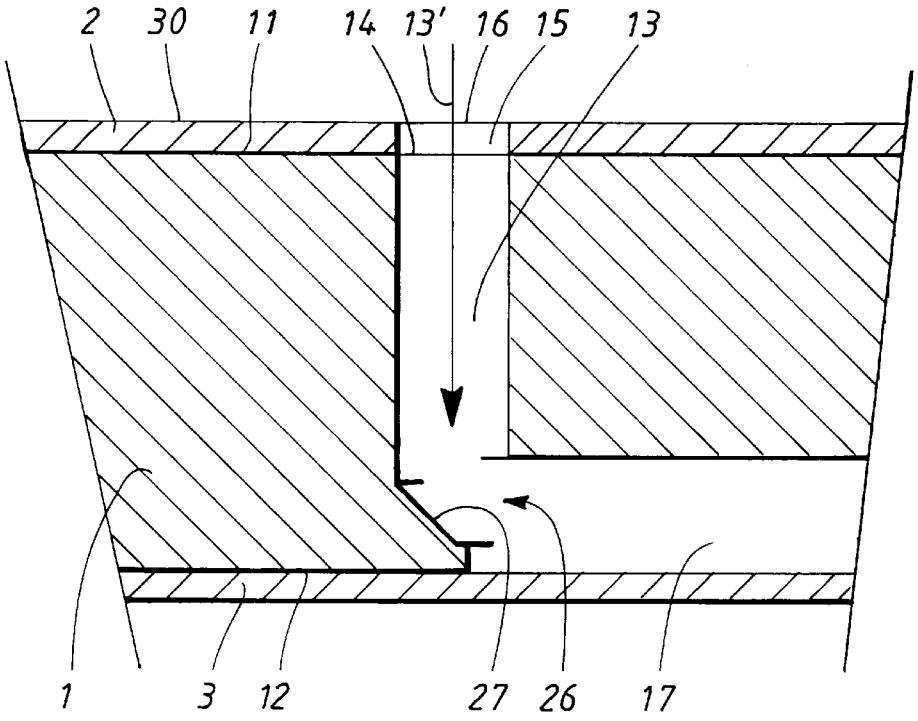

As can for example be seen from FIGS. 1 and 2, the wave guide arrangement according to the invention is a plate structure, consisting of a body plate 1, which on its opposite sides or main surfaces is mainly or partially covered by two covering plates 2, 3, one covering plate on each side. The body plate is thus essentially plate shaped, and is arranged to house a number of the wave guides or other microwave components which, by different shaping of cavities, i.e. holes, in the covering plate, and connection of the covering plates 2, 3, form the different microwave components with separate functions. The body plate 1 is preferably given such a thickness that it allows wave guides to be separated from each other even when crossing each other, see for example locations 4 and 5 in FIG. 1. The wave guides in the body plate 1 consist both of wave guide grooves 6, 7, 8, 9, 10, 17 which extend along either of the main surfaces 11, 12 of the body plate 1 which surfaces usually are parallel to each other, and of wave guide sections 13, which extend at an angle relative to the main surfaces 11, 12, for example a straight angle, and with openings 14 end in either of the main surfaces 11, 12 and which by means of a through-going opening 15 in either of the covering plate 2, 3 end with an opening 16 in its outer surface 30. In connection to the opening 16 there is usually arranged a separate component, for example a microwave hybrid with an amplifier, a mixer, receiver protection, or an electrical switch. The wave guide grooves 6–10, 17 in the main surfaces 11, 12 are preferably obtained by means of milling, so that the grooves obtain an essentially rectangular cross section. The wave guide sections 13, the main extension or perpendicular direction of which forms an angle, for example a straight angle, against the main surfaces 11, 12 are formed in the body plate 1, and the covering plates 2, 3 by means of milling in the same step of production.

FIG. 1 shows an example of a plate structure where the main part of one covering plate 2 is shown removed, so that the main part of the body plate 1 is seen from its one main surface 11, so that the different wave guide grooves 6–10 on the one side of the body plate, and a number of microwave components are visible. The body plate 1 is in FIG. 1 removed in the upper left corner, thus causing the opposed covering plate 3 to be seen. The wave guides formed by the wave guide grooves 6–10 with the corresponding covering plate 2, 3, and the angled wave guide sections 13 have the purpose of forming transmission means for microwaves between different microwave components. The wave guide grooves 6–10, shown with solid lines, are thus arranged in the one main surface 11 of the body plate 1 while sections of the wave guide groove 17 are arranged in the opposed main surface 12 of the body plate, and is therefore indicated with lines with dots. One and the same wave guide can, via wave guide bends 18, pass from one main surface 11 of the body plate (see for example wave guide groove 9) to its other main surface 12 (see for example wave guide groove 17), whereby the above mentioned crossings 4, 5, can be made in different planes. In this way, the constructions of circuits is facilitated, and a very compact construction is enabled. The wave guides 6–10, 17, are primarily given simple geometrical shapes in order to transmit microwave signals with a minimum of attenuation and distortion. As far as possible, they extend in a straight line, with straight sections to which are added so called H-bends and E-bends, depending on whether the change of direction of the wave guides is in the plane of the main surfaces or at an angle to it.

FIG. 1 shows a number of a different H-bends 6', 6", which are 90° and 30°. The shape and the angles can be chosen from a large number of alternatives, according to what is necessary.

As mentioned above, the plate structure according to the present invention makes it possible to integrate several microwave components for the processing of the microwave signals in the body plate 1 and the covering plates 2, 3. An example apart from the wave guide is shown in FIG. 1, in the shape of filter components 19, 20, 21, the construction of which is shown in detail by means of an example in FIG. 5, which will be described further below.

From FIG. 1 it will become apparent that the filter components 19, 20, 21 are completely integrated in the plate structure, since the filter components have been made by shaping the walls of the wave guides. FIG. 1 shows a further example of a microwave component in the shape of a circulator 22, arranged in a branching of the wave guides 9, 10, 23. There is further a plurality of E-bends 18, 24, which are used either when the wave guide grooves pass from one main surface 11 to the other main surface 12, or to an opening in either of the covering plates 2, 3. Separate wave guide components, not shown in FIG. 1, are intended to be connected to these openings, usually by means of flanges. These are screwed onto the respective covering plates 2, 3, or also on to the body plate 1, in which there is arranged a number of screw holes 25 around each opening.

FIG. 2 shows an example of one of the wave guide bends 26 here called a deep E-bend, and which here leads a wave guide screw in one main surface 12 of the body plate 1 across to its opposed main surface 11, via the wave guide section 13. In order to achieve good transmission of the microwave signals in the wave guide, the bend has a sloping surface 27. This is produced by letting a rotating cylindrical mill first be moved in the direction of the arrow 13', down into the body plate 1, after which it is moved in parallel along a chosen angle sideways up to the groove 17.

Figure 3:
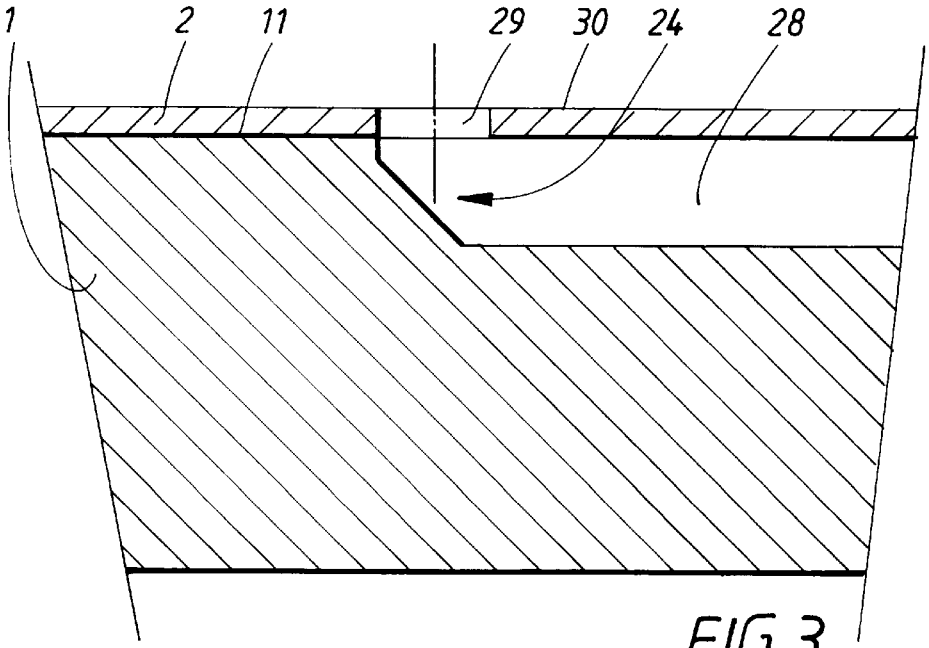
FIG. 3 shows a cross-section of a wave guide arrangement in a part which has a wave guide component in the shape of a short E-bend.

The example in FIG. 3 shows a so called short E-bend 24, see also FIG. 1, which is used when a wave guide groove 28 opens in the main surface 11, on that side of the covering plate 1 along which the groove extends. A connecting opening 29 leads the wave guide to the outwards facing surface 30 of the covering plate 2, on which the separate microwave components can be connected.

Figure 4:
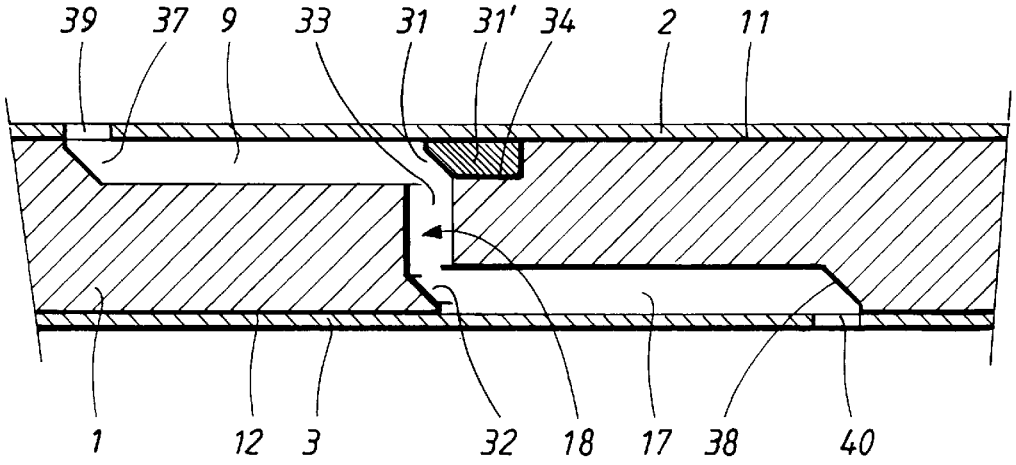
FIG. 4 is a cross section through the wave guide arrangement to the invention, which shows a wave guide component in the form of a so called separate bend element.

FIG. 4 can essentially be seen as a cross section of the bend 18 according to FIG. 1, although the surrounding wave guides extend differently. This design is used when, for example, the wave guide groove 9 which extends along the one main surface 11 of the body plate crosses to the wave guide groove 17 which extends along the opposite main surface 12. As can be seen from the figure, the bend is a double bend, with a first bend 31 arranged in connection to the one main surface 11 of the body plate 1, and a second bend 32 arranged in connection to the other main surface 12. A wave guide section 33 extends between the two bends at an angle to the main surfaces, which, in the example, shown is a straight angle. For reasons of production, there is in connection to the one bend 31 arranged a loose bend element 33, which has been mounted in a recess 34 in the body plate 1, subsequent to the manufacturing of the wave guide section 33 by, for example, milling, in the direction from the one main surface 11 of the body plate 1, in the manner which has been described above with reference to FIG. 2. In the example shown in FIG. 4 there are bends 37, 38 also at the outer ends of the wave guide grooves 9, 10. These connect to respective connection openings 39, 40 in their corresponding covering plate 2, 3, on which, as has been mentioned above, other separate microwave components can be connected for processing of the microwave signals which are transmitted in the wave guides in the plate structure.

Figure 5:
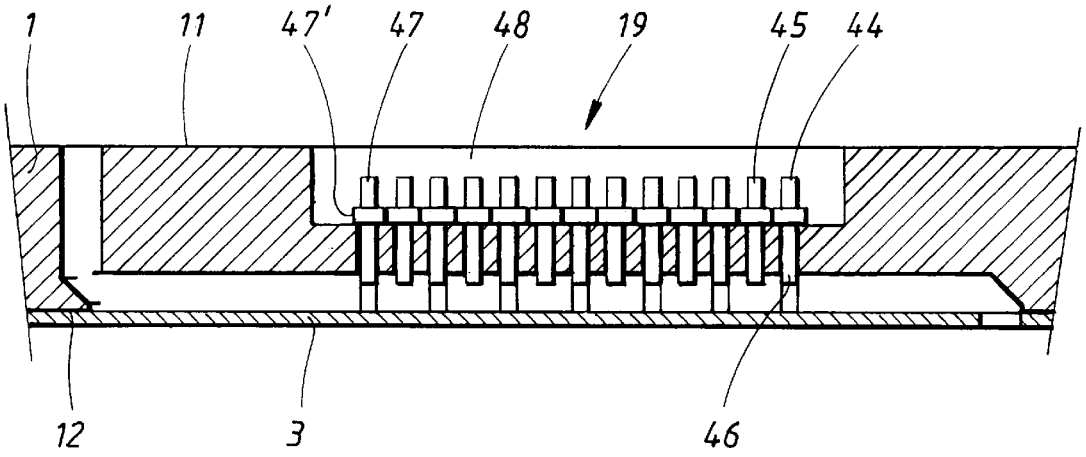
FIG. 5 is a cross section through the wave guide arrangement, which shows an example of a micro wave component which is a band pass filter.

The cross section according to FIG. 5 can essentially be seen as a cross section through any of the filter components 19, 20, 21, although the surrounding wave guides are of a different extension. As can be seen in FIGS. 1 and 5, the filter component is fully integrated in the plate structure, to be more precise, in the body plate 1. The plate structure is here shown with only one covering plate 3 in this particular part. This is due to the fact that the opposite covering plate 2 does not need to cover the entire surface of the body plate, but can be so arranged that it covers only a limited part of one of its two main surfaces 11, 12. The covering plates can be so arranged that there are several smaller covering plates, which can be arranged in different places on the main surfaces, or in a recessed portion in the main surfaces where the recess preferably corresponds to the thickness of the covering plate, so that a smooth and essentially plane outer surface is obtained, which in turn can support separate components. As can be seen in FIGS. 1 and 5, the functions of the band pass filter have been partially obtained by forming cavities in the body plate 1. Thus, there is arranged a plurality of plates 41, 42 in the filter which, for example, is a band pass filter which has been formed by protruding wall sections arranged in pairs facing each other, thus forming cavities 43. A plurality of trim screws 44, 45 are arranged for adjustment of the filter. The trim screws are of two kinds, first such trim screws as 44, which are arranged between the plates to adjust the impedance and also such screws as 45, which are arranged in the cavities for adjustment of the frequency. The trim screws in various degrees form portions 46 which protrude downwards, and which change the mentioned filter characteristics, and thereby the electrical characteristics of the wave guides. Each trim screw is thus equipped with a thread, and can be displaced in the direction of its extension in threaded drill holes in the body plate 1, and are also equipped with a head 47, and a locking nut 47', arranged in a recessed section 48 of the body plate. The head 47 and the locking 47' nuts can be accessed from the one main surface 11 using a trim screw driver.

Figure 6:
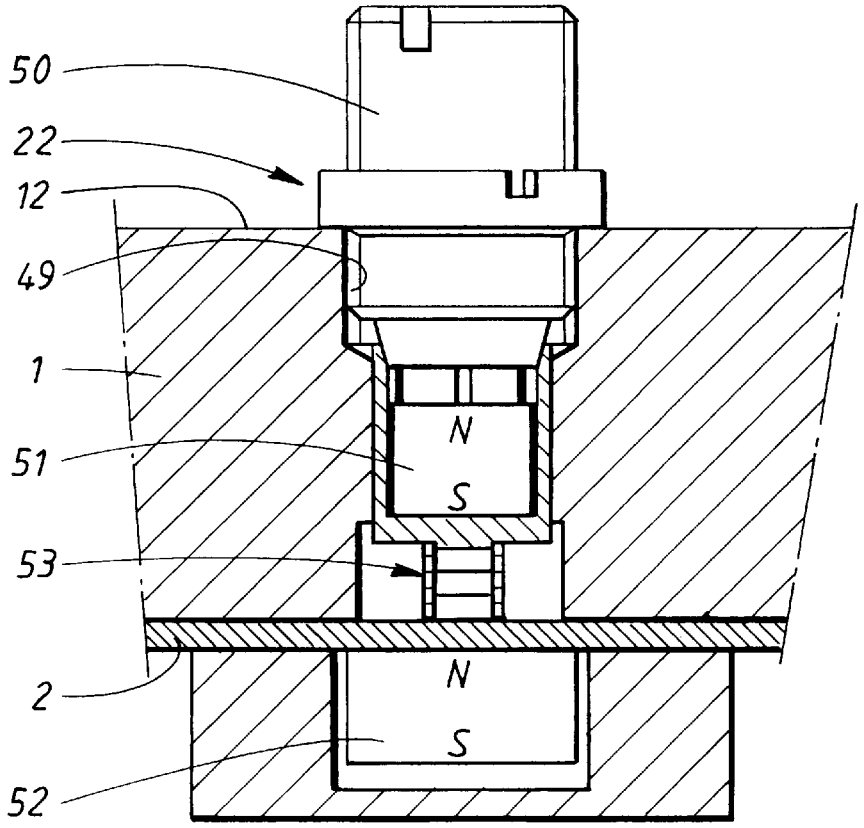

FIG. 6 shows an example of the integration of a circulator 22, see also FIG. 1. The purpose of the circulator is to together with a branching, enable isolation of at least one path of transmission depending on which direction the microwave energy is received in. This is used in order to separate paths of transmission of, for example, transmitted respectively received signal, so that the receiver to a high degree is isolated from the transmitted microwave energy, which is at a considerably higher level than the energy level received. From FIG. 6 it will become apparent that the circulator 22 is for example of the ferrite circulator kind, mounted in a bore 49 in the body plate 1 and encases a first magnet 51 and protrudes with a section 50 from the body plate. The circulator also comprises a second magnet 52. The circulator further protrudes downwards with a portion 53, which contains ferrite cores in the branching point of the three wave guides grooves 9, 10, 23. This part of the body plate 1 is also without the one covering plate 3 in the example shown.

Figure 7:
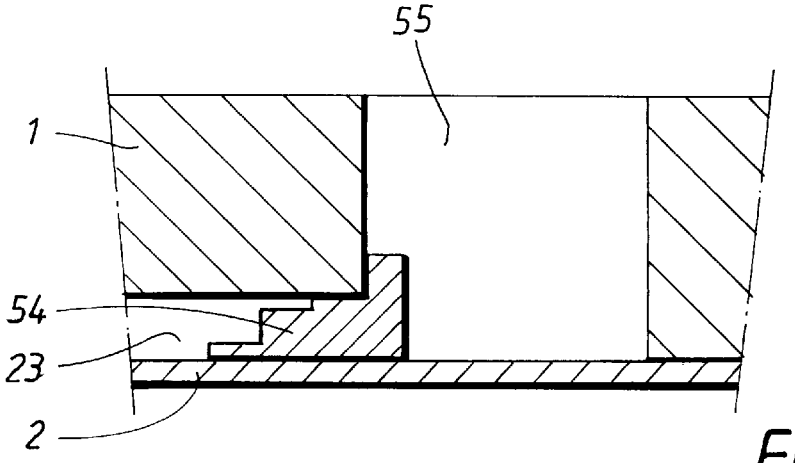
FIG. 7 is a cross section through a wave guide component in the shape of a termination.

FIG. 7 shows a termination element 54 for the attenuation of reflections in a wave guide groove 23, which is another example of a microwave component which can be, in a simple way, assembled on, and integrated in the plate structure, more precisely in a recess 55 in the body plate 1. On one side of this, one of the covering plates 3 is arranged.

Figure 8:
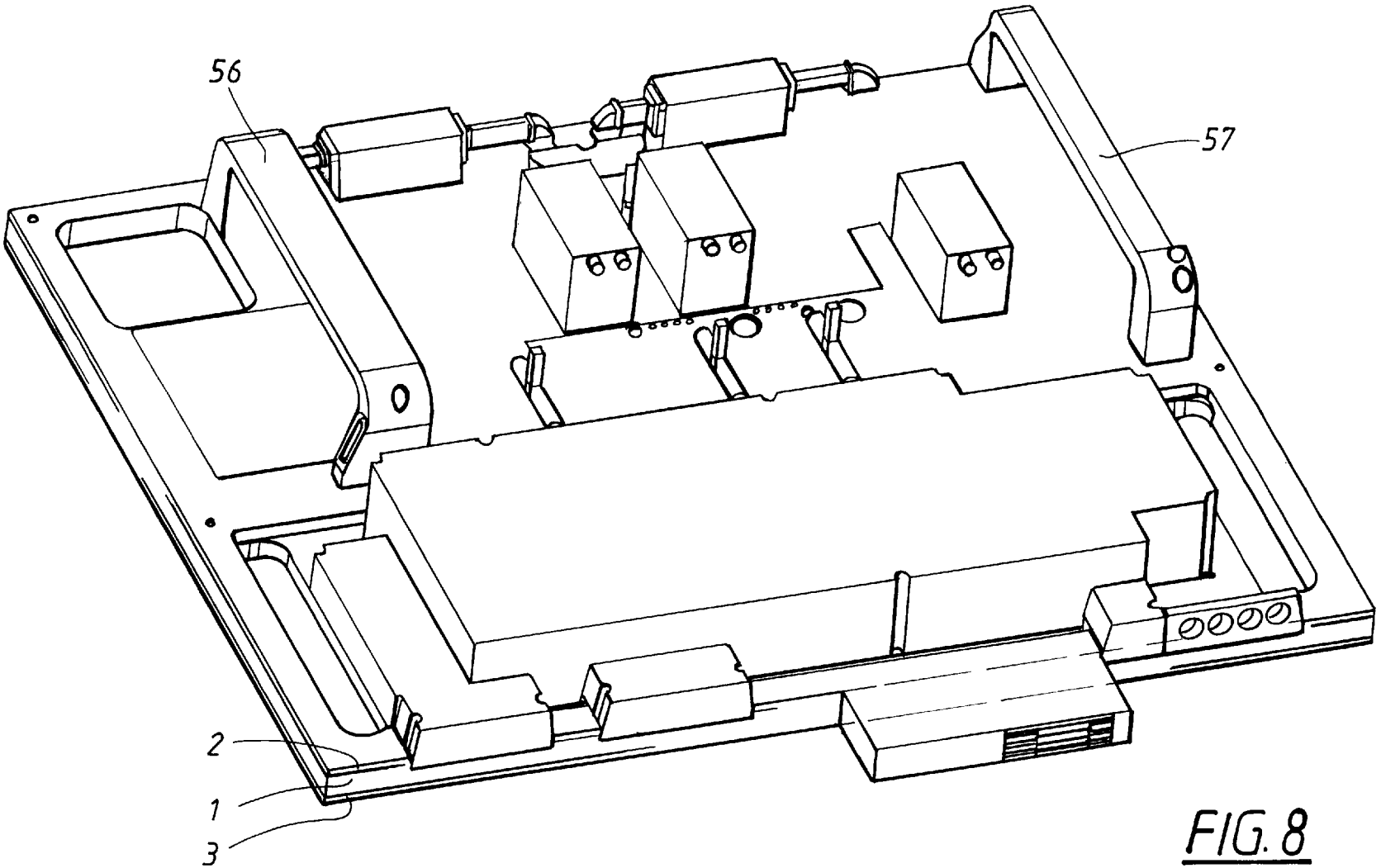
FIG. 8 is a perspective view of a complete unit with a wave guide arrangement, as well as other components mounted on it.

FIG. 8 shows, in a perspective view, an example of a complete microwave module constructed with the plate structure according to the invention. From this, it will come apparent that the plate structure, apart from the above described construction with integrated microwave components in the structure itself, also supports separate microwave components, which are arranged on the top side or bottom side of the body plate 1 and/or the covering plates 2, 3. The separate microwave components, can be such that they are easily replaceable. They can be preproduced standard components or can be of such a design that they cannot be integrated into the plate structure, they can be so called microwave hybrids, and thus not be only wave guide components etc. The entire unit can be made especially easy to handle by equipping it with carrying handles 56, 57, as in the example shown, which makes the unit easy to move for service etc, and which, at the same time constitutes a protection for microwave components. The unit can be mounted in, for example, a rack with several units, and can be mounted vertically, horizontally or at a sloping angle to the vertical plane.

The production of the plate structure according to the invention can be summed up in the following way. The initial material for the body plate 1 is a massive plate of an electrically conducting material, for example aluminum or an alloy of it. The plate has, for example, rectangular surfaces with its two main surfaces 11, 12 plane and parallel, possibly with stepwise changes in level. The thickness of the body plate, i.e. the distance between the main surfaces 11, 12 at least in the crossings exceeds double the depth of the wave guide grooves. According to a predetermined pattern the wave guide grooves are made by a for example, computer controlled mill, which can be of different kinds, with a cylindrical rotating milling head which creates a mainly rectangular profile shape with perpendicular side edges and a plane bottom. The wave guide grooves are preferably milled on both sides of the body plate, i.e. in its two main surfaces 11, 12. The wave guide sections which are at an angle to the main surfaces are then made at predetermined positions by means of milling. All the bends are made with their specially designed surfaces.

The covering plates 2, 3 can be made separately from the body plate, by drilling or milling in order to create attachment holes or connection openings. Alternatively, this can be done at a later stage after the covering plates have been connected to the body plate.

The covering plates 2, 3 are connected to the body plate subsequent to placing a very carefully measured amount of solder between the covering plates and the body plate, after which the covering plates by means of salt bath soldering are solded together with the body plate, so that the wave guide grooves in the main surfaces obtain predetermined crosswise dimensions.

The invention is not limited to the embodiments described above and shown in the examples, but can be varied within the scope of the appended patent claims. For example, completely different microwave components can both be integrated and/or supported by the structure. Examples of such components are variable attenuators, other kinds of filters such as low pass and high pass filters, isolators, power splitters, directional couplers etc.

What is claimed is:

1. A waveguide arrangement for transmitting and processing microwave signals, comprising:

a plate structure with recesses which form waveguides for transmitting microwave signals between microwave components, wherein the plate structure is formed by a body plate and at least two covering plates which are at least partially connected to two opposite surfaces of the body plate; the body plate is a solid plate of an electrically conducting material;

both the body plate and the covering plates form delimiting surfaces for at least a part of the waveguides; the at least part of the waveguides is formed mainly by grooves in at least one of the opposite surfaces of the body plate; the grooves end in connection openings in the respective covering plate; the depth of at least part of the grooves is less than the thickness of the body plate; and at least part of the microwave components are arranged in at least one of the body plate and the covering plates.

2. The waveguide arrangement of claim 1, wherein the waveguides comprise waveguide sections which connect to the grooves and extend at an angle relative to the opposite surfaces of the body plate.

3. The waveguide arrangement of claim 2, wherein the waveguides comprise waveguide bends formed by shaped grooves and connections of the grooves to the waveguide sections in the body plate.

4. The waveguide arrangement of claim 3, wherein at least one of the connection openings is arranged in connection to that surface of the body plate with the corresponding shaped groove; and for connection of the groove to the connection opening, one of the bends is arranged at the surface with the shaped groove.

5. The waveguide arrangement of claim 3, wherein at least one of the connection openings is arranged in connection to that surface of the body plate which is opposite that surface with the corresponding shaped groove; and for connection of the groove to the connection opening, one of the bends is arranged in the area of the same surface with the shaped groove.

6. The waveguide arrangement of claim 2, wherein the connection between the waveguide sections and the grooves comprises bends; and at least one bend is arranged at a distance from one of the connection openings, and is formed by a separate bend element positioned in a recess in the body plate.

7. The waveguide arrangement of claim 5, wherein at least one of the grooves is terminated by a separate termination element arranged for sealing one end of the groove between the body plate and its corresponding covering plate.

8. The waveguide arrangement of claim 6, wherein the separate bend element forms one bend in a double bend for the transition between grooves in the two opposite surfaces of the body plate; and one of the bends in the double bend is positioned at one of the surfaces and the other bend in the double bend is positioned at the other surface.

9. The waveguide arrangement of claim 1, wherein at least one of the microwave components is a circulator positioned in a recess which extends between one wall of the body plate to a branching point of a groove in the opposite surface.

10. The waveguide arrangement of claim 1, wherein the microwave components in the body plate are formed in the body plate.

11. The waveguide arrangement of claim 10, wherein at least one of the microwave components is a filter component formed by a plurality of fixed plates arranged in the body plate.

12. The waveguide arrangement of claim 11, wherein the filter component comprises a plurality of trim screws which are arranged in bores in the body plate, which are accessible from one surface of the body plate, and which are adapted to adjust the filter component.

13. The waveguide arrangement of claim 1, wherein the waveguides have rectangular shapes.

14. The waveguide arrangement of claim 1, wherein the waveguides are arranged on both sides of the body plate.

* * * * *